US010950994B2

(12) United States Patent
Meshram

(10) Patent No.: US 10,950,994 B2
(45) Date of Patent: Mar. 16, 2021

(54) QUICK CONNECT/DISCONNECT COAXIAL CABLE CONNECTOR

(71) Applicant: John Mezzalingua Associates, LLC, Liverpool, NY (US)

(72) Inventor: Nikhil B. Meshram, Liverpool, NY (US)

(73) Assignee: JOHN MEZZALINGUAASSOCIATES, LLC, Liverpool, NY (US)

( * ) Notice: Subject to any disclaimer, the term of this patent is extended or adjusted under 35 U.S.C. 154(b) by 0 days.

(21) Appl. No.: 16/487,524

(22) PCT Filed: Mar. 2, 2018

(86) PCT No.: PCT/US2018/020723
§ 371 (c)(1),
(2) Date: Aug. 21, 2019

(87) PCT Pub. No.: WO2018/164964
PCT Pub. Date: Sep. 13, 2018

(65) Prior Publication Data

US 2020/0059050 A1 Feb. 20, 2020

Related U.S. Application Data

(60) Provisional application No. 62/469,816, filed on Mar. 10, 2017.

(51) Int. Cl.
*H01R 13/62* (2006.01)
*H01R 24/54* (2011.01)
(Continued)

(52) U.S. Cl.
CPC ..... *H01R 24/54* (2013.01); *H01R 13/6277* (2013.01); *H01R 13/639* (2013.01); *H01R 2103/00* (2013.01)

(58) Field of Classification Search
CPC .. H01R 24/54; H01R 24/542; H01R 13/6277; H01R 13/639; H01R 2103/00
(Continued)

(56) References Cited

U.S. PATENT DOCUMENTS 5,195,904 A 3/1993 Cyvoct
5,938,465 A 8/1999 Fox
(Continued)

OTHER PUBLICATIONS

USPTO (ISA/US), International Search Report and Written Opinion from PCT international Appl. No. PCT/US18/20723, completed by Apr. 27, 2018 (dated May 15, 2018).
(Continued)

*Primary Examiner* — Khiem M Nguyen
(74) *Attorney, Agent, or Firm* — Barclay Damon LLP

(57) ABSTRACT

A quick connect and release mechanism is provided for a coaxial cable connector comprising a first connector body having an annular cavity accessible by a tubular opening. A conical retention ring is disposed in the annular cavity and engaging at least one radial step form along a rearwardly facing surface of the annular cavity and, furthermore, being configured to engage a retention surface of a second connector body upon insertion of a tubular sleeve thereof. Furthermore, a retention ring engager is disposed over a portion of the first connector body and has a sleeve portion extending into the tubular opening to urge the retention ring from engagement with the at least one radial step while also disengaging the retention surface of the second connector. As a consequence, the second connector is released from the first connector.

18 Claims, 7 Drawing Sheets

(51) Int. Cl.
*H01R 13/627* (2006.01)
*H01R 13/639* (2006.01)
*H01R 103/00* (2006.01)

(58) Field of Classification Search
USPC ..... 439/299, 578–585
See application file for complete search history.

(56) References Cited

U.S. PATENT DOCUMENTS

| | | | | |
|---|---|---|---|---|
| 7,189,097 | B2 * | 3/2007 | Benham | H01R 13/629 439/352 |
| 7,695,302 | B2 * | 4/2010 | Eissner | H01R 13/6277 439/352 |
| 8,814,441 | B2 * | 8/2014 | Strasser | G02B 6/3893 385/56 |
| 2003/0129873 | A1 | 7/2003 | Heebe et al. | |
| 2003/0153210 | A1 | 8/2003 | Huber et al. | |

OTHER PUBLICATIONS

International Preliminary Examining Authority, International Preliminary Report on Patentability from PCT International Appl. No. PCT/US18/20723, completed by Apr. 10, 2019 (dated Apr. 22, 2019).

* cited by examiner

QUICK CONNECT/DISCONNECT COAXIAL CABLE CONNECTOR

CROSS-REFERENCE TO RELATED APPLICATIONS

This application is a non-provisional patent application of, and claims the benefit and priority of, U.S. Provisional Patent Application No. 62/469,816 filed on Mar. 10, 2017. The entire contents of such applications are hereby incorporated by reference.

BACKGROUND

Telecommunications systems employ a variety of connectors, inter alia, to: (i) couple one length of coaxial cable to another length of cable, (ii) connect a length of coaxial cable to an RF telecommunications device such as a remote radio head, a sector antenna, or a base station controller, (iii) join a headend data line to a drop line, (iv) couple one coupling divider to a subsequent divider, or (v) adapt one coaxial cable to a smaller or larger cable, etc. Such connectors come in a variety of types including dropline, network, F-type, Mini-Din, 4.3-10, etc.

Preparation/coupling typically requires the use of several special and conventional tools including a stripping tool, a compression tool and a torque wrench etc. The stripping tool removes a portion of the compliant outer jacket to expose a signal-carrying inner conductor and an outer grounding, or braided, conductor of the cable. A compression tool, on the other hand, inserts a grounding/retention post into the prepared end of the cable to effect an electrical and mechanical connection between the cable and an outer body of the cable connector. The torque wrench turns a rotatable coupler (i.e., a female coupler) at the end of the connector body to threadably engage a threaded interface, port, or another connector (i.e., a male coupler.)

Amongst the many challenges faced by designers of coaxial connectors, one of the largest continues to be the time that a lineman expends making cable connections, especially when he/she is fifty (50) feet in the air alongside a telecommunications tower. Inasmuch as threaded connections generally provide the best mechanical connection, they continue to be employed despite the time required to effectuate such connections.

Therefore, there is a need to overcome, or otherwise lessen the effects of, the disadvantages and shortcomings described above.

BRIEF DESCRIPTION OF THE DRAWINGS

Additional features and advantages of the present disclosure are described in, and will be apparent from, the following Brief Description of the Drawings and Detailed Description.

SUMMARY OF THE INVENTION

A quick connect and release mechanism is provided for a coaxial cable connector comprising a first connector body having an annular cavity accessible by a tubular opening. A conical retention ring disposed in the annular cavity and engaging at least one radial step form along a rearwardly facing surface of the annular cavity and, furthermore, being configured to engage a retention surface of a second connector body upon insertion of a tubular sleeve thereof. A retention ring engager is disposed over a portion of the first connector body and has a sleeve portion extending into the tubular opening to urge the retention ring from engagement with the at least one radial step while also disengaging the retention surface of the second connector. As a consequence, the second connector is released from the first connector.

DETAILED DESCRIPTION

Figure 1:
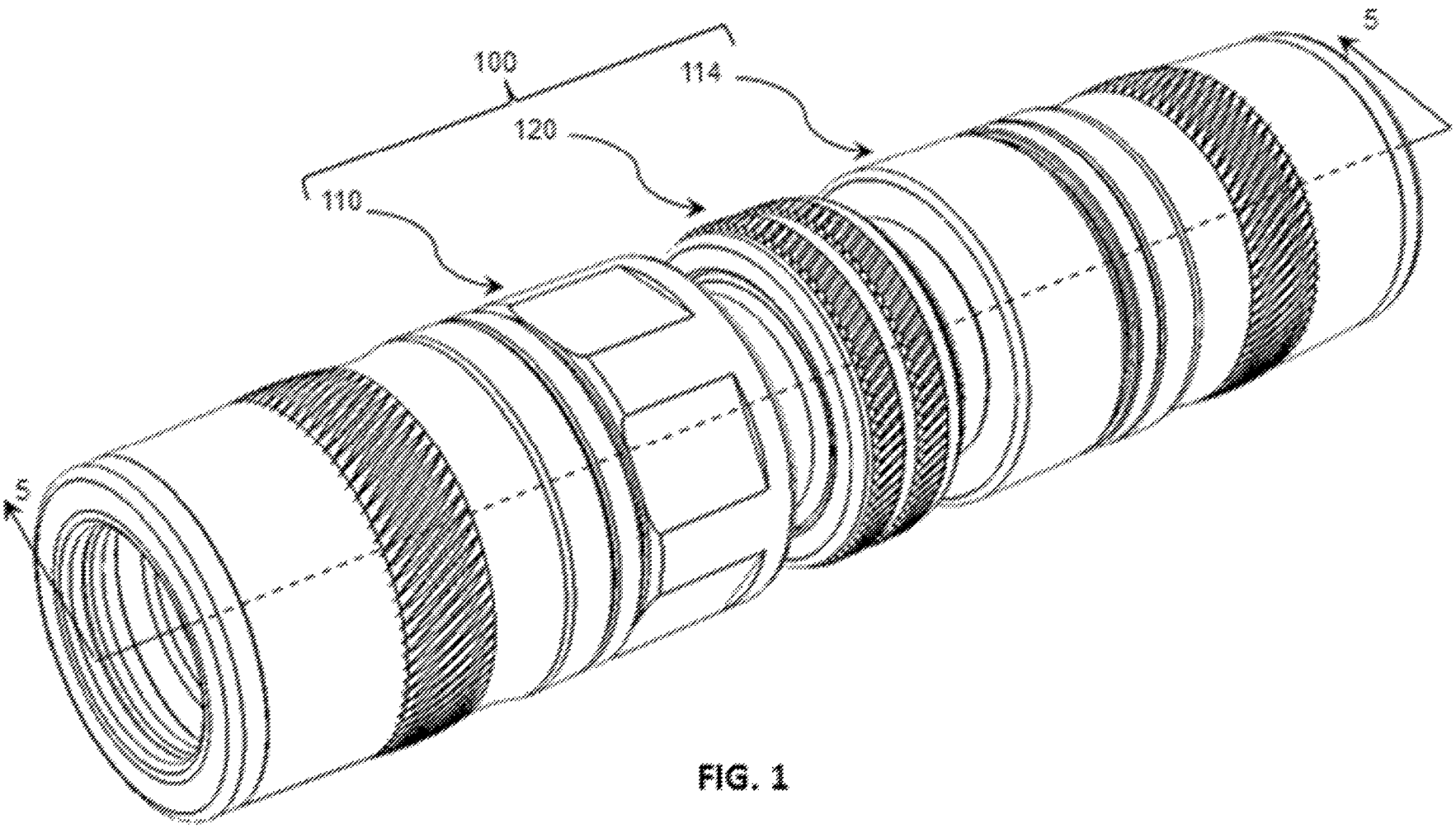
FIG. 1 is an perspective view of the coaxial cable connector according to a first embodiment, including a male connector, a female connector and a quick connect/release mechanism therebetween for rapid assembly and disassembly of the connector.
Figure 2:
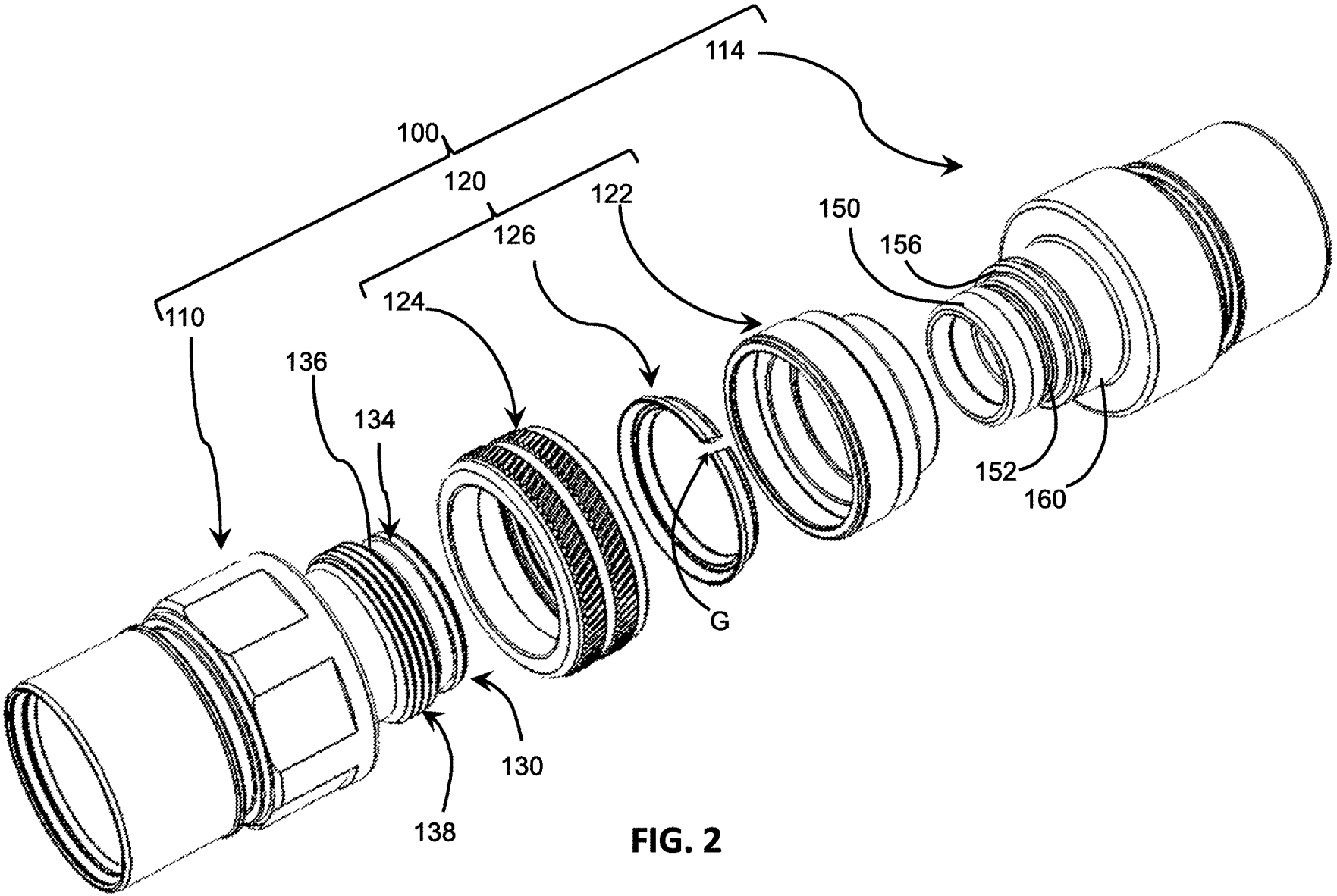
FIG. 2 is an exploded view of the coaxial cable connector shown in FIG. 1 wherein the quick connect/release mechanism further includes a split conical retention ring, a male connector insert operative to capture the retention ring and a retention ring engager operative to engage and disengage a tapered surface of the conical retention ring.
Figure 3:
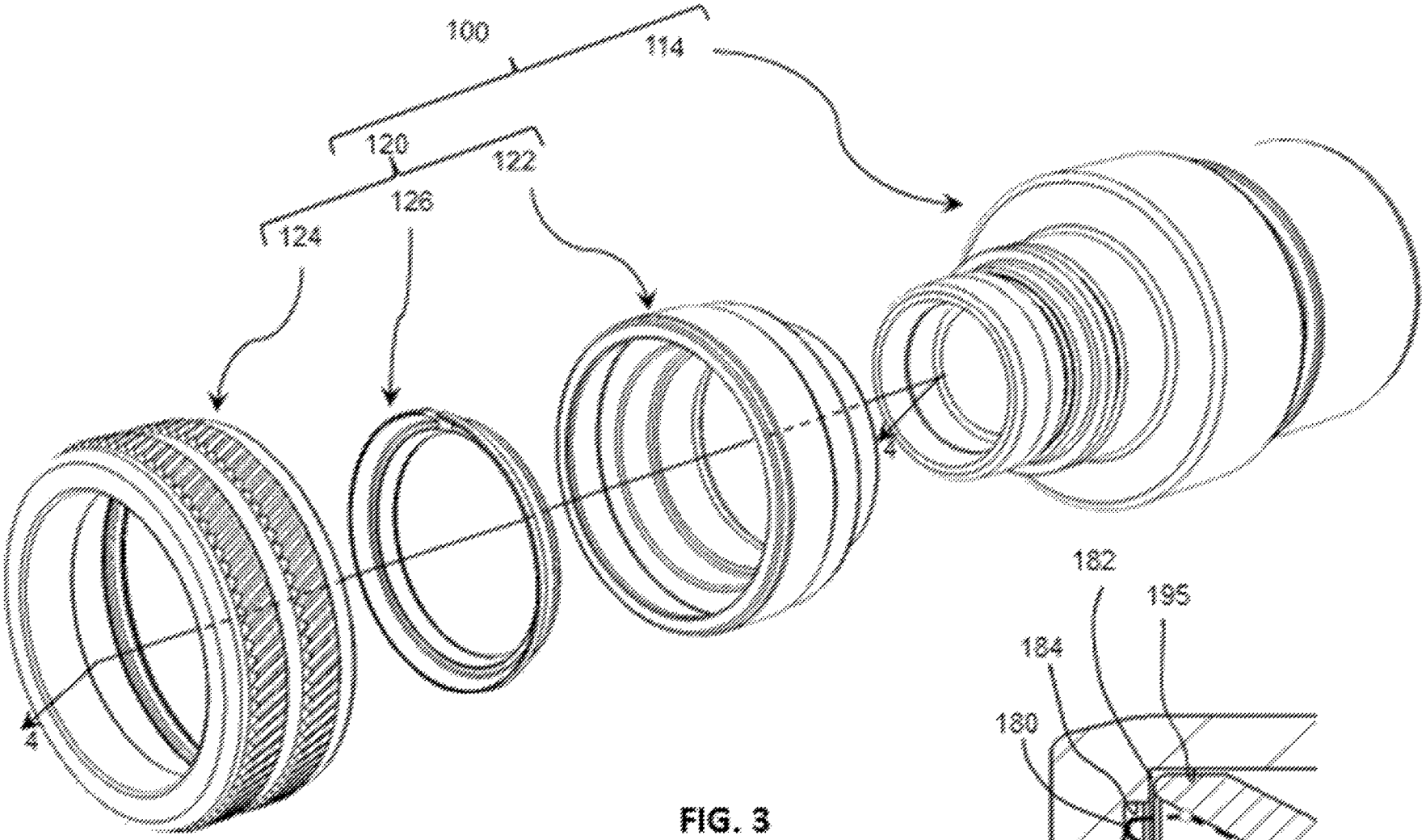
FIG. 3 is an enlarged exploded view of the male connector portion of the coaxial cable connector.
Figure 11:
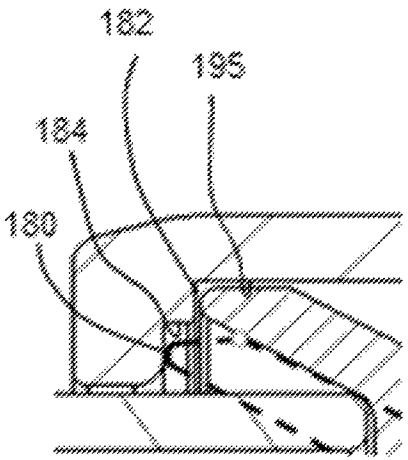
FIG. 11 is an enlarged view of a region 11 in shown in FIG. 10 to better show a pair of radial steps in the rearwardly facing surface of the annular cavity of the male connector insert.
Figure 4:
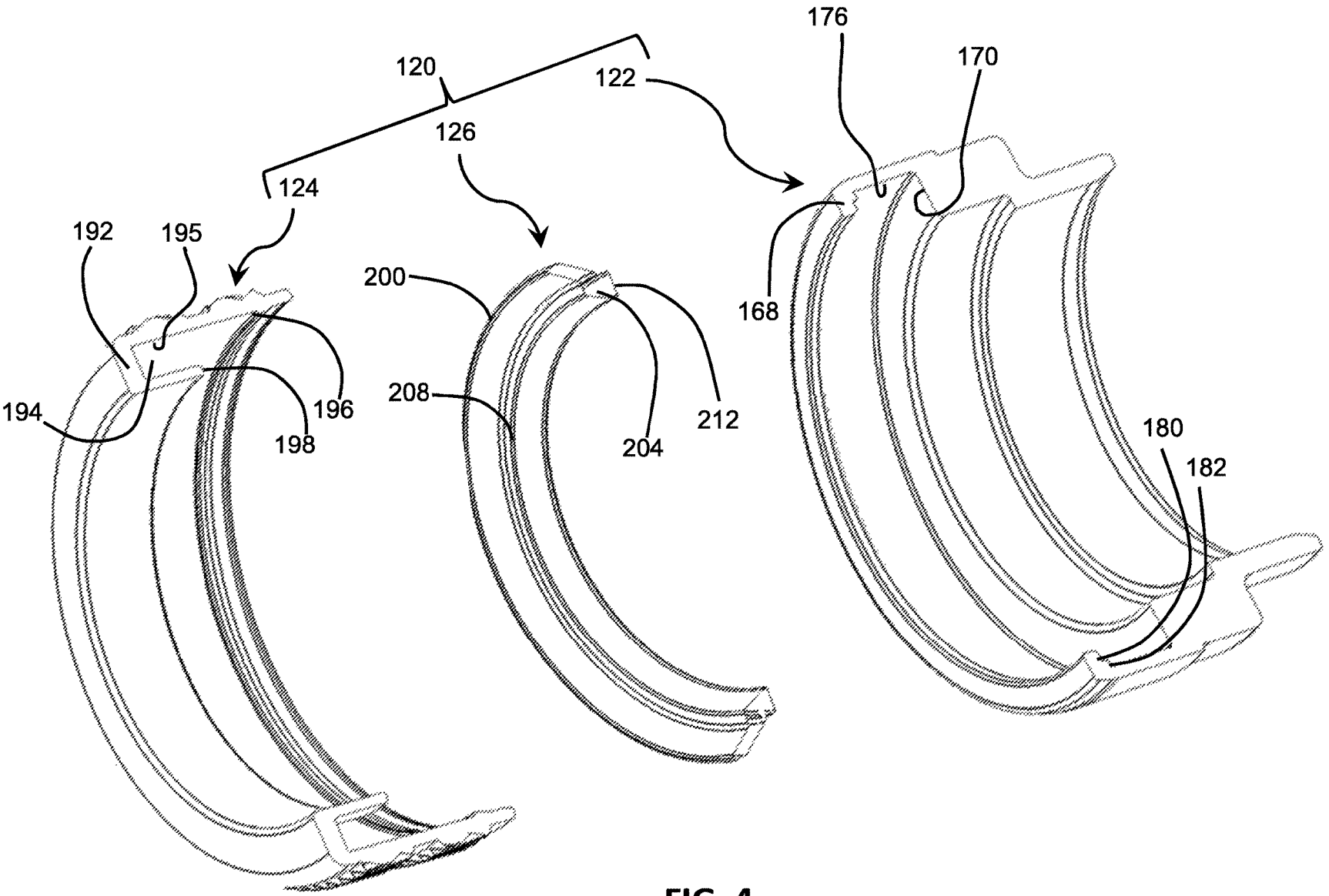
FIG. 4 is an cross-sectional view of the quick connect/release mechanism taken substantially along line 4-4 of FIG. 3.
Figure 5:
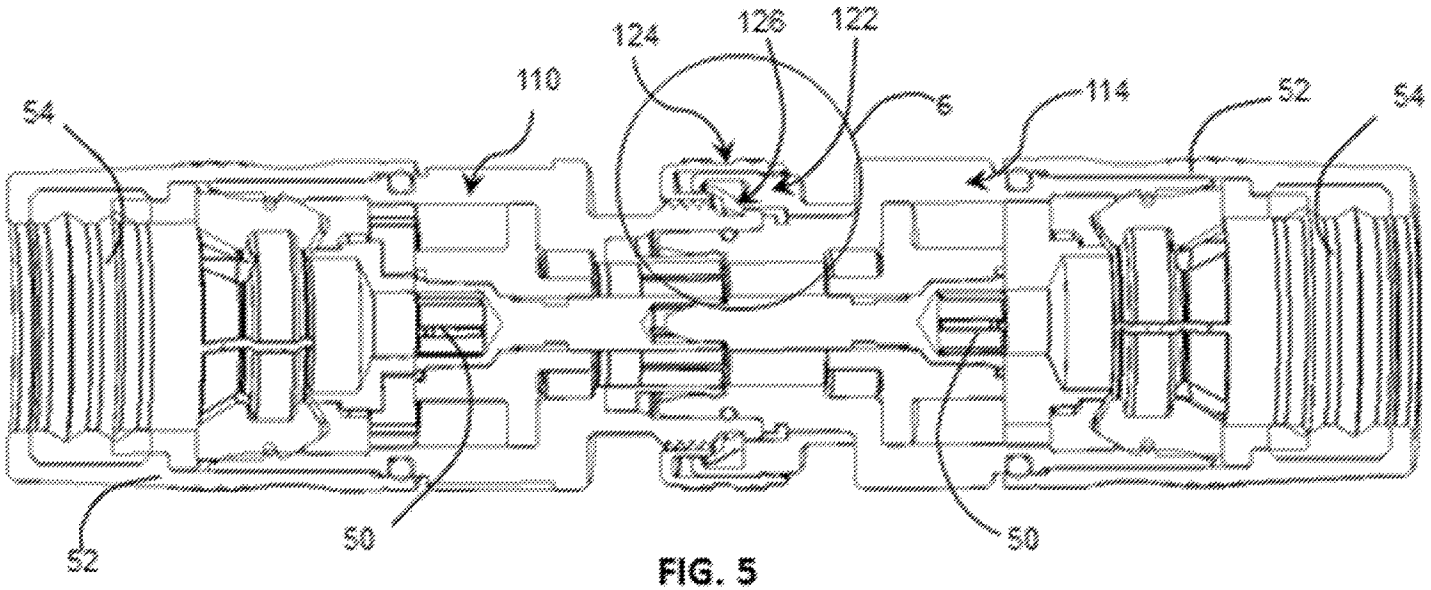
FIG. 5 is an cross-sectional view of the quick connect/release mechanism taken substantially along line 5-5 of FIG. 1.
Figure 6:
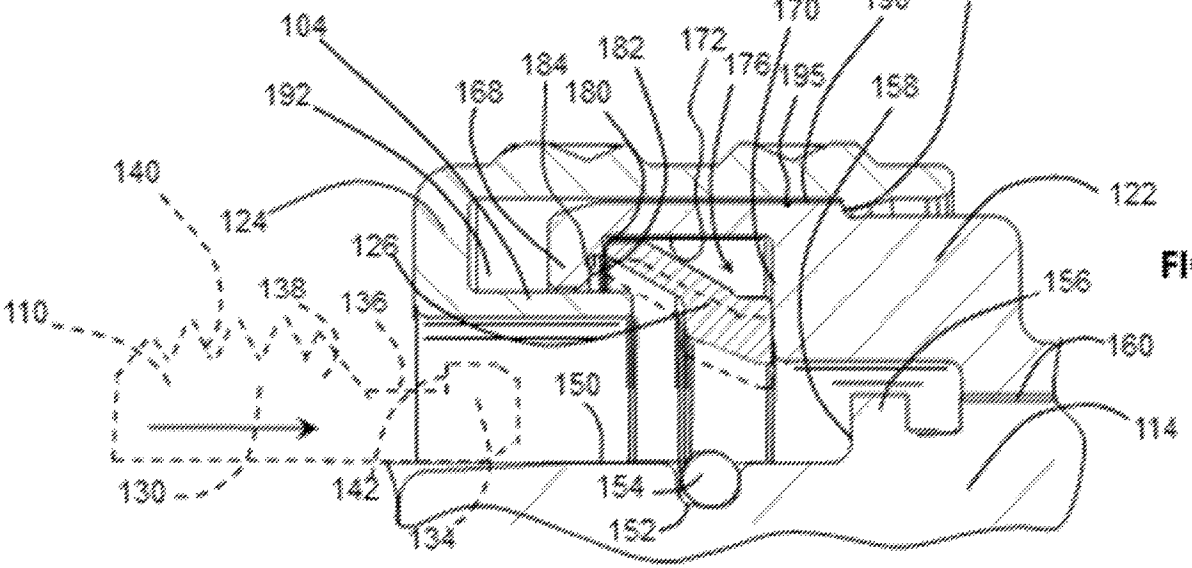
FIG. 6 is an exploded view of a region 6 identified in the cross-sectional view depicted in FIG. 5 including a split conical retention ring is seated within an annular cavity of a male connector insert.
Figure 7:
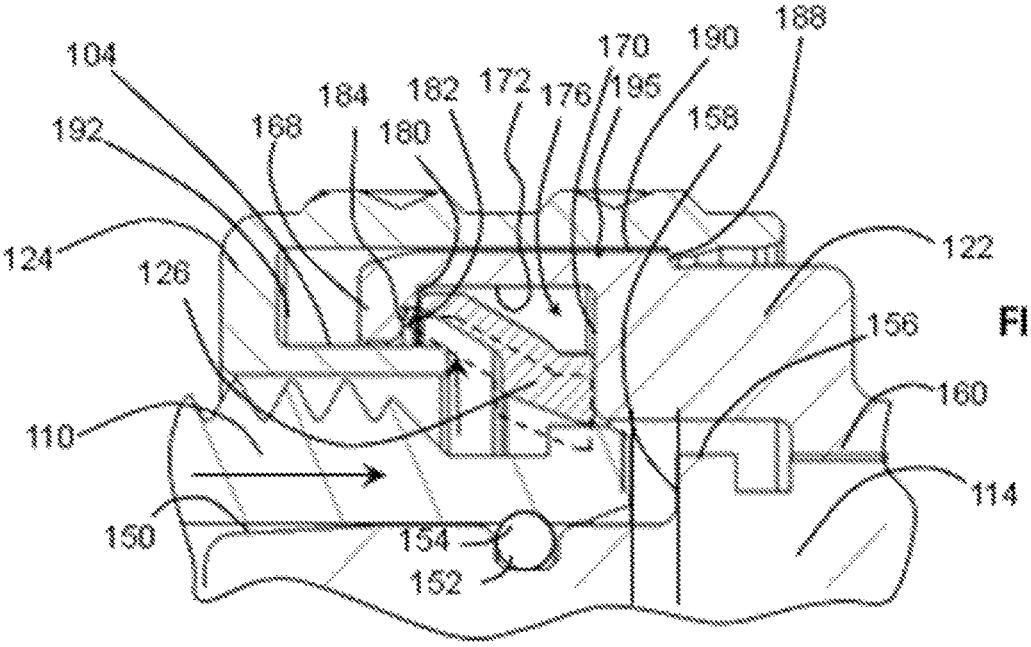
FIG. 7 depicts the exploded view of FIG. 6 wherein the female connector is partially inserted into an annular opening between the male connector insert and the retention ring engager and wherein the female connector is in a pre-installed position immediately prior to quick connect/release mechanism.
Figure 8:
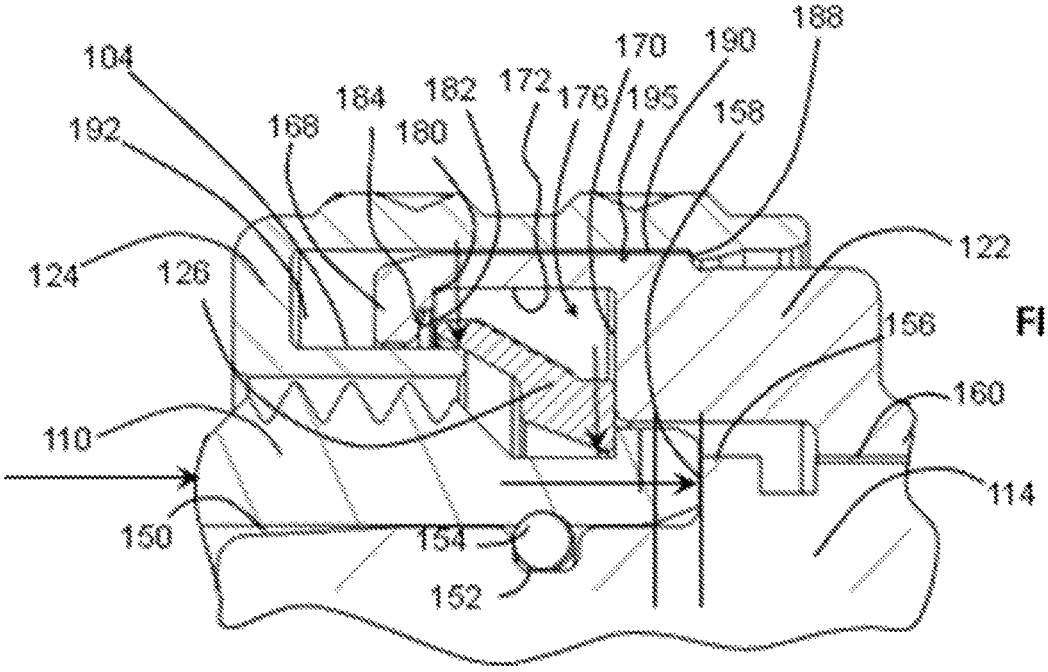
FIG. 8 depicts the exploded view of FIG. 6 wherein the female connector is fully inserted into the annular opening, and wherein the retention ring is spring biased to close radially inward to capture the retention ring in the annular groove of the female connector.
Figure 9:
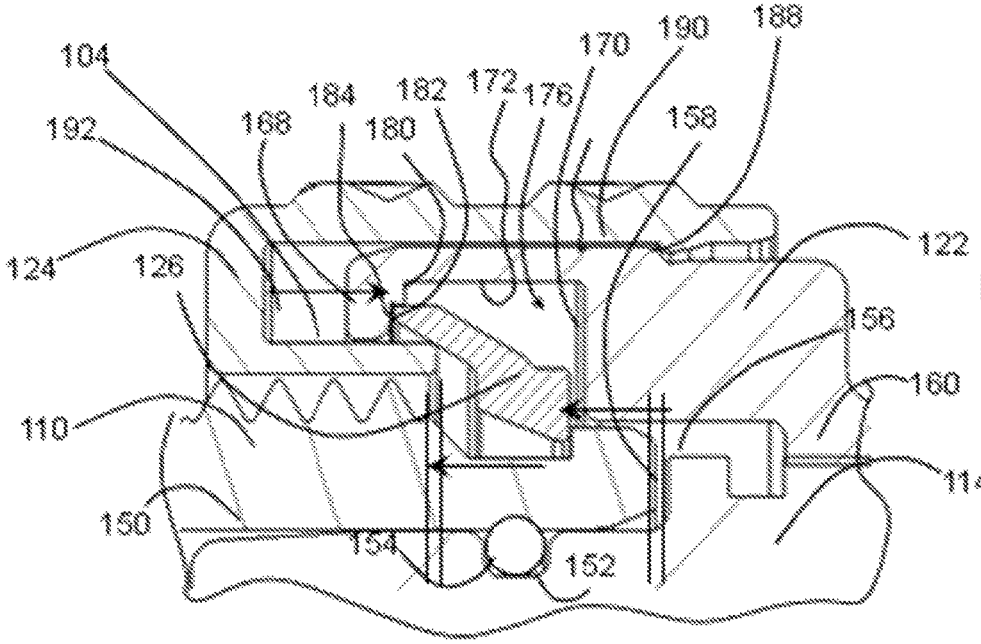
FIG. 9 depicts the exploded view of FIG. 6 wherein the female connector is fully inserted into the annular opening such that a base of the retention ring engages a shoulder of the female connector thereby preventing retraction of the female connector when a tensile load pulls the male and female connectors apart.
Figure 10:
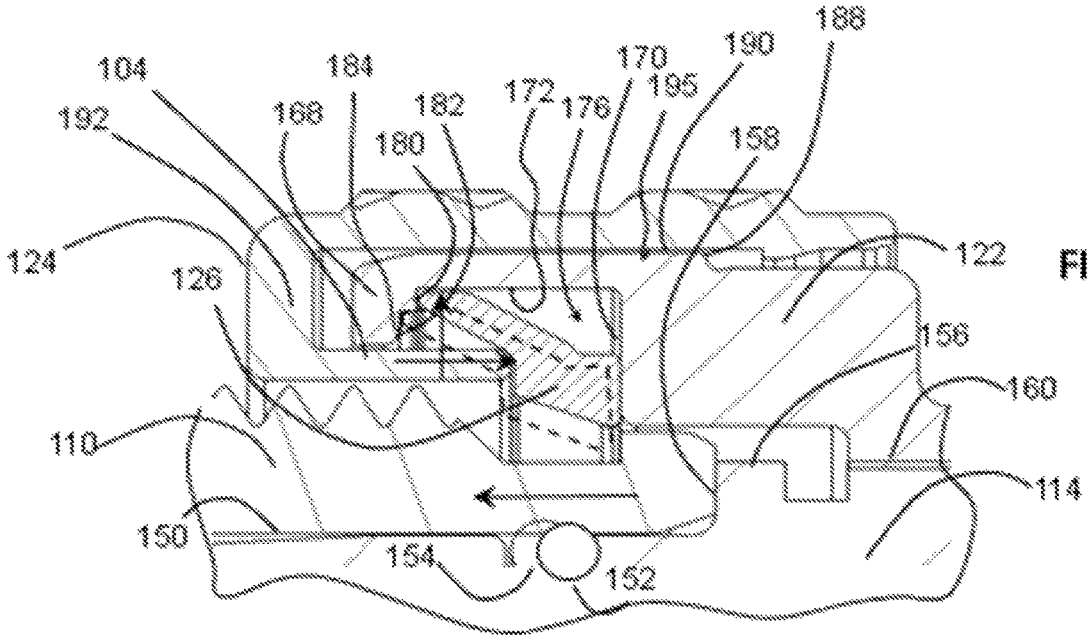
FIG. 10 depicts the exploded view of FIG. 6 wherein the retention ring engager is pulled toward the male connector such that the retention ring engager spreads the split retention ring out of out of engagement with the shoulder of the female connector, thereby facilitating release of the female connector from the annular opening of the male connector.

According to one embodiment, depicted in the perspective view of FIG. 1, a coaxial cable connector 100 comprises a female connector 110, a male connector 114, and a quick disconnect/release mechanism 120 disposed therebetween. In FIGS. 2-6 the quick disconnect/release mechanism 120 further comprises a male connector insert 122, a retention ring engager 124 and a split conical retention ring 126. Before discussing the functional operation of the various elements of the coaxial cable connector 100, the structural features of each element will first be discussed in isolation.

In the described embodiment, each of the female and male connector bodies 110, 114 include a first end which is mechanically and electrically connected to a prepared end of a coaxial cable (not shown). Specifically, the ends of each coaxial cable are stripped, stepped and folded-back to expose the inner and outer electrical conductors of the coaxial cable. An inner conductor includes central, signal-carrying, wire electrically-insulated and separated from an outer grounding conductor by a dielectric core. An electrical socket 50 (See FIG. 5) receives and bares down on the wire pin to carry signals across the connector 100, from the female to male connectors 110, 114. The core material is surrounded by a foil layer which separates the braided outer conductor from the dielectric core. A conductive post is interposed between the conductive outer braid and the foil layer while a fastener 52 collapses an outer compression member 54 around the conductive outer braid of the cable. Finally, an electrically-compliant, elastomer, outer jacket surrounds the braided grounding wire for the purposes of sealing and preventing moisture from short-circuiting the connection.

The female connector 110 comprises a threaded tubular sleeve 130 opposite the end which accepts or connects a coaxial cable (not shown). The tubular sleeve 130 includes an outwardly projecting flange 134 defining an annular groove or recess 136 between the flange 134 and the axially outermost thread 136 of the connector threads 138. Moreover, the outwardly projecting flange 134 defines a shoulder or retention surface 142 facing rearwardly toward the opposite end of the female connector 110. The tubular sleeve 130 is conductive and is preferably fabricated from a brass or brass alloy to prevent damage to harder metals, i.e., other metal that the brass female connector 110 my come into contact.

The male connector 114 comprises a smooth cylindrical sleeve 150 which may be tapered to facilitate a smooth connection between the male and female connectors 110, 114. The sleeve 150 includes an outwardly facing recess 152 for receiving an O-ring seal 154 (see FIG. 6) and a radially projecting flange 156 disposed axially inboard of the outwardly facing recess 152. The flange 156 defines an outwardly facing abutment surface 158 operative to limit the relative axial displacement of the male connector 110 relative to the female connector 114. That is, when the connectors 110, 114 are joined, the female connector 110 contacts the abutment surface 158 to limit the relative axial displacement of male and females=connectors 110, 114. Similar to the tubular sleeve 130 of the female connector 110, the tubular sleeve 150 of the male connector 114 is conductive and is preferably fabricated from a brass or brass alloy. The use of a soft brass or brass alloy mitigates damage to harder metals, i.e., other metal components that the brass female connector 110 my come into contact.

In the described embodiment, a male connector body or insert 122 is a separate element from, i.e., not integral with, the male connector 114 and may be press-fit over a tubular end portion 160 of the male connector 114. The male connector body or insert 122 is separate to facilitate fabrication/machining of a annular cavity or recess 176, i.e., a recess 176 formed by a radially inwardly projecting flange 168, an axially outwardly facing wall 170 and a radially inwardly facing wall 172 connecting the radially inwardly projecting flange 168 and the axially outwardly facing wall 170. The inwardly projecting flange 168 defines a pair of vertically oriented surfaces 180, 182 separated by an axial surface 184. As will be discussed in greater detail hereinafter, the axial surface 184 affects the displacement of the central retention ring 126 and the manner in which the retention ring 126 retains and/or releases the male and female connectors 110, 114. Finally, the male connector insert 122 includes a retention shoulder 188 disposed along the upper or outwardly facing surface 190 of the insert 122.

The retention ring engager 124 is a generally cylindrically shaped which is disposed over the outwardly facing surface 190 of the male connector insert 122. The engager 124 includes a recurved flange 192 which extends into the tubular opening formed between an edge of the inwardly projecting flange 168 and the outwardly facing surface 150 of the male connector 114. More specifically, the recurved flange 192 extends over and around the outer surface of the male connector insert 122 to define an annular cavity 194 between the engager 124 and the insert 122. Additionally, the interior surface of the annular cavity defines a stop surface 196 operative to engage the retention shoulder 188 formed along the outwardly facing surface of the insert 122. Consequently, the engager 124 is capable of sliding axially over the outer surface of the male connector insert 122 until such displacement is limited by the stop surface 196 and the retention shoulder 188. Finally, the retention ring engager 124 includes an edge 198 configured to engage a surface of the retention ring 126 to release the retention ring 126 from its engaged position, i.e., a position wherein the retention ring 126 engages the retention surface of the female connector 110.

The retention ring 126 is split to form a C-shaped member and has a generally frustoconical shape. An edge portion 200 thereof extends radially outboard from a base portion 204 which includes a forward engagement surface 208 and an aft retention surface 212. The retention ring 126 is, furthermore, biased to in an open configuration, i.e., such that a gap G is created between the ends of the split. The gap G allows the retention ring 124 to open wider or close tighter depending upon its location/position within the annular recess 176. While in a closed position, the retention ring 124 maintains a smaller diameter and is generally in a position denoted by the dashed lines in FIG. 6. In an open or release position, the retention ring 124 is briefly opened to a wider diameter and is generally in a position denoted by the solid lines in FIG. 6. Similar to the tubular sleeve 130 of the female connector 110, the retention ring engager 124 and retention ring engager 126 are conductive and preferably fabricated from a brass or brass alloy.

In operation, the tubular sleeve of the female connector 110 is inserted into the tubular opening between the retention ring engager 126 and the outwardly facing surface 150 of the male connector 114. Inasmuch as the retention ring 126 is biased closed, the retaining surface 212 engages a retention surface 142 (FIG. 6) of the female connector 110. As such, when a tensile load is applied to the male and female connectors 110, 114, the retention ring reacts the tensile load to couple the connectors 110, 114. In this position, the edge 200 of the retention ring 126 engages a first radial step 184 of male connector insert 122.

To release the female connector 110 from the male connector 114, the retention ring engager 124 urges the retention ring 126 out of engagement with the first radial step 184. The retaining surface 212 disengages the retention surface 142 of the female connector 110, thereby allowing the female connector 110 to slide past the retention ring 126, out of engagement with the male connector 114.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

The invention claimed is:

1. A coaxial cable connector comprising:

a first connector body mounting to a coaxial cable at one end, the first connector body having:

a tubular sleeve defining an outwardly facing surface, a radially outwardly projecting flange defining an outwardly facing abutment surface, a radially inwardly projecting flange directed toward the radially outwardly facing abutment surface, defining an annular cavity and at least one radial step along an axially rearwardly facing internal surface thereof, the edge of the radially inwardly projecting flange and the outwardly facing abutment surface defining a tubular opening, a split retention ring disposed in the annular cavity, the retention ring having an outwardly facing edge engaging the at least one radial step and an inwardly facing edge configured to engage a retention surface of a second connector body, the retention surface producing a radial interface with the second connector body which is normal to the elongate axis of the first and second connector bodies; and a retention ring engager having a sleeve portion extending into the tubular opening to urge the retention ring from engagement with the at least one radial step and with the retention surface of the second connector body.

2. The coaxial cable connector of claim 1 wherein the retention ring is fabricated from a soft conductive material.

3. The coaxial cable connector of claim 1 wherein the retention ring is biased closed to retain the first and second connector bodies.

4. The coaxial cable connector of claim 1 wherein the retention ring is urged to a larger diameter by the retention ring engager to release the first and second connector bodies.

5. The coaxial cable connector of claim 1 wherein a first connector insert is integral with the first connector body.

6. The coaxial cable connector of claim 1 wherein a first connector insert is a separate element from the first connector body and is press-fit onto the first connector body.

7. A quick connect and release mechanism for a coaxial cable connector comprising:

a first connector body having an annular cavity accessible by a tubular opening, the annular cavity having at least one radial step formed along a rearwardly facing internal surface of the annular cavity;

a retention ring disposed in the annular cavity, the retention ring having an outwardly facing edge engaging the at least one radial step and being configured to engage a retention surface of a second connector body, the retention ring having an outwardly facing edge engaging the at least one radial step and an inwardly facing edge configured to engage a retention surface of a second connector body, the retention surface producing a radial interface with the second connector body which is normal to the elongate axis of the first and second connector bodies; and a retention ring engager disposed over a portion of the first connector body and having a sleeve portion extending into the tubular opening to urge the retention ring from engagement with the at least one radial step thereby releasing the retention ring from engagement from the retention surface of the first connector.

8. The coaxial cable connector of claim 7 wherein the retention ring is fabricated from a soft conductive material.

9. The coaxial cable connector of claim 7 wherein the retention ring is biased closed to retain the second and first connectors.

10. The coaxial cable connector of claim 7 wherein the retention ring is urged to a larger diameter by the retention ring engager to release the second and first connectors.

11. The coaxial cable connector of claim 7 wherein a first connector insert is integral with the first connector body.

12. The coaxial cable connector of claim 7 wherein a first connector insert is a separate element from the first connector body and is press-fit onto the first connector body.

13. A quick connect and release mechanism for a coaxial cable connector comprising:

a first connector body having an annular cavity, the annular cavity having at least one radial step formed along a rearwardly facing internal surface of the annular cavity, the radial step configured to receive a retention ring, the retention ring configured to move from a closed position to an open position;

wherein, in the closed position, the retention ring engages the at least one radial step to retain a second connector;

wherein, in the open position, the retention ring disengages the at least one radial step to separate the first and second connector bodies; and wherein the retention surface produces a radial interface with the second connector body which is normal to the elongate axis of the first and second connector bodies.

14. The coaxial cable connector of claim 13 wherein the retention ring is fabricated from a soft conductive material.

15. The coaxial cable connector of claim 13 wherein the retention ring is biased closed to retain the second and first connectors.

16. The coaxial cable connector of claim 13 wherein the retention ring is urged to a larger diameter by the retention ring engager to release the second and first connectors.

17. The coaxial cable connector of claim 13 wherein a first connector insert is integral with the first connector body.

18. The coaxial cable connector of claim 13 wherein a first connector insert is a separate element from the first connector body and is press-fit onto the first connector body.

* * * * *